US007077469B2

(12) United States Patent
Badia i Farré

(10) Patent No.: US 7,077,469 B2
(45) Date of Patent: Jul. 18, 2006

(54) SEAT FURNITURE

(76) Inventor: Jordi Badia i Farré, Europa 12, 08028-Barcelona (ES)

( * ) Notice: Subject to any disclaimer, the term of this patent is extended or adjusted under 35 U.S.C. 154(b) by 0 days.

(21) Appl. No.: 10/220,672

(22) PCT Filed: Mar. 23, 2001

(86) PCT No.: PCT/ES01/00115

§ 371 (c)(1),
(2), (4) Date: Sep. 4, 2002

(87) PCT Pub. No.: WO01/72177

PCT Pub. Date: Oct. 4, 2001

(65) Prior Publication Data

US 2003/0034678 A1 Feb. 20, 2003

(30) Foreign Application Priority Data

Mar. 30, 2000 (ES) ..... 200000791

(51) Int. Cl.
*A47C 7/02* (2006.01)

(52) U.S. Cl. ..... 297/202; 297/195.11

(58) Field of Classification Search ..... 297/195.1, 297/195.11, 202, 452.23, 452.26
See application file for complete search history.

(56) References Cited

U.S. PATENT DOCUMENTS 568,626 A * 9/1896 Pierce ..... 297/202
612,972 A * 10/1898 Leech ..... 297/202
1,858,477 A * 5/1932 Blake ..... 297/202
2,508,932 A * 5/1950 Turner ..... 297/212
3,580,634 A 5/1971 Bock
4,366,981 A * 1/1983 Ziegler et al. ..... 297/328
4,671,570 A 6/1987 Hockenberry et al.
4,932,719 A * 6/1990 Gonzalez y. Rojas ..... 297/338
5,540,484 A 7/1996 Grundei et al.
5,681,092 A 10/1997 Hanson et al.
5,927,797 A * 7/1999 Ferguson ..... 297/4
5,927,810 A 7/1999 Liao
D417,560 S * 12/1999 Tollefson et al. ..... D6/354
6,193,309 B1 * 2/2001 Gootter et al. ..... 297/202

FOREIGN PATENT DOCUMENTS

| | | |
|---|---|---|
| ES | 2128470 | 5/1999 |
| FR | 2611462 | 9/1988 |
| WO | WO 9408491 A | 4/1994 |

* cited by examiner

*Primary Examiner*—Peter R. Brown
(74) *Attorney, Agent, or Firm*—Scully, Scott, Murphy & Presser, P.C.

(57) ABSTRACT

In this piece of furniture, which is taller than a normal chair, the seat as such is located at a such height as to allow the user to rest the user's feet on the floor or on a footrest and is constituted by a body that is differentiated at the top by a rear seat portion for the user's buttocks and a higher front portion that, inserted between the user's thighs, allows the user to sit astride it, this front portion being differentiated, lengthwise down the centre, into two parallel portions that, being mirror images, are spaced apart to define therebetween an open space located in correspondence with the user's genital area.

6 Claims, 2 Drawing Sheets

SEAT FURNITURE

DESCRIPTION

The present invention relates to a seat, particularly one incorporating part of the features characteristic of seats of the high stool type, insofar as it constitutes an individual seat that is taller than a normal chair and the user, when sitting thereon, rests the user's feet on the floor or on a footrest.

To be precise, the proposed seat consists of a technically ergonomic piece of furniture, since the purpose behind it is that the user thereof may carry out a task, without altering the balanced posture of the erect human body, which represents a substantial reduction of muscular fatigue.

The term "ergonomic" applied to any equipment is often used thinking more of the activity for which it has been designed than with a clear idea of its adaptation to human physiology. This interpretation is frequently the result of preconceived ideas, such as that the ideal posture for carrying out any task optimally is being sitting. In the light of recent biomechanical studies it is seen that this idea is based more on anthropology than on physiology.

One of the most frequent causes of discomfort or incapacity at work is the dorsolumbar pains, popularly known as "backache" or "kidney ache."The majority of these pains are caused the discrepancy between the balanced or "neutral" posture, (namely, that of a biped, natural posture of the human species, acquired throughout phylogenetic evolution), and the posture of work, which is generally that of sitting, with the trunk at 90° relative to the nearest segment of the lower extremities. In the biped, the following physiological curves of the spine from the lumbar to the cervical region are observed: lumbar lordosis (bulged to the front), dorsal kyphosis (bulged to the back) and cervical lordosis. If a spine is observed from the side in the sitting posture, it is seen that both lumbar lordosis and cervical lordosis become flattened or are inverted. This is because the pelvis, the bony structure where the column is articulated, tilts backward when the person is sitting. In this way, the rear ligaments and muscle systems are subjected to undesirable stress, and an imbalance is created relative to the abdominal muscles, which are antagonists thereof. This situation is aggravated when the person leans forward, a posture in which, further to increasing the muscular tension, there is originated a significant increase of the pressure on the intervertebral discs (Nachemson Alf. "Towards a better understanding of pain in the lumbar region."Rheumatology and Rehabilitation. 1975). These factors cause both the muscular contractures and the discal overloads, which are the cause of most dorsolumbar pains.

In view of such drawbacks, a seat that allowed the physiological curves of the back to be maintained, even when leaning forward, would be desirable.

In accordance with the foregoing premises, the solution has been adopted of designing a seat based on riding saddles.

Therefore, the seat of the invention has been developed, which is characterized, essentially, in that the seat as such is situated at a such height as to allow the user to rest the user's feet on the floor or on a footrest and is constituted by a body that at the upper end thereof, on the surface of use, is differentiated into in a rear seat portion for the user's buttocks and a higher front portion which, inserted between the user's thighs, allows the user to sit astride it, said front portion being differentiated, lengthwise down the centre, into two parallel portions that, being mirror images, are spaced apart to define therebetween an open space located in correspondence with the user's genital area.

A feature of the invention consists of the distance in height between the seat body and the floor or footrest being such that, when the user is sitting astride this seat body with the user's feet being rested, the user's thighs and trunk form an angle of the order of 135° to each other.

The invention contemplates that the open space, formed between the two parts of the front portion of the seat body, constitutes a deep gap that extends across the full thickness of said seat body, or is a pronounced recess or a transverse step that only affect an upper portion of the thickness of the seat body, should this be of considerable thickness.

According to a preferred embodiment, the seat body is of compound plan, which may be said to be, approximately, constituted by the association of a semi-elliptical surface with an isosceles trapezoidal surface of curvilinear sides, the longer parallel side of which is coincident with the major axis of the semi-ellipse.

A practical embodiment of the foregoing preferred embodiment is to be found in that the seat body, being of considerable thickness, has a flat lower surface and a bulged upper surface of varying curvature that defines the surfaces of each of the front and rear portions which are continuous and extend from one to the other without a break. The rear portion forms a gently concave surface that, transversely arcuate, tends to rise centrally at the curvilinear free edge thereof to form an rear retaining region of the user's body, at the same time as, in opposition to said region, it continues, in warped form, in the front portion which is formed by two coplanar, parallel rectilinear stretches of greater height, the side surface of which is transversely curved and sloping downwardly towards the outside, which stretches, being mirror images, configure therebetween a separation space across the entire thickness of the thick seat body.

The invention contemplates that the seat body is installed on a support structure standing on the floor or the like that is of adjustable height to adjust it so that the user, supporting the user's feet on the floor or on a footrest, maintains the user's thighs at an angle of about 135° with the user's trunk. Furthermore, the said seat body is attached to the support structure with spring means in such a way so as to allow it to rock backwards and forwards.

The invention contemplates the facts that the seat body is susceptible of being supplemented with a back-rest and/or arm-rests, either directly related therewith or with the support structure and that the front and rear portions of the seat body are independent members which may be associated with one another by positional adjustment means, in the front-to-back direction, in order to bring them closer together or space them apart. Similarly, the seat body can be differentiated into two independent side members which may also be associated with one another in the transverse direction.

To facilitate the understanding of the foregoing ideas, certain embodiments of the invention are described herein below, with reference to the accompanying illustrative drawings, in which:

FIG. 1 schematically shows the balanced or neutral posture of the human spine, when the body is standing erect.

FIG. 2 schematically shows the usual sitting posture, in which the trunk forms an angle of 90° relative to the nearest segment of the lower extremities.

FIG. 3 schematically shows the sitting posture on the seat of the invention.

Figure 1:
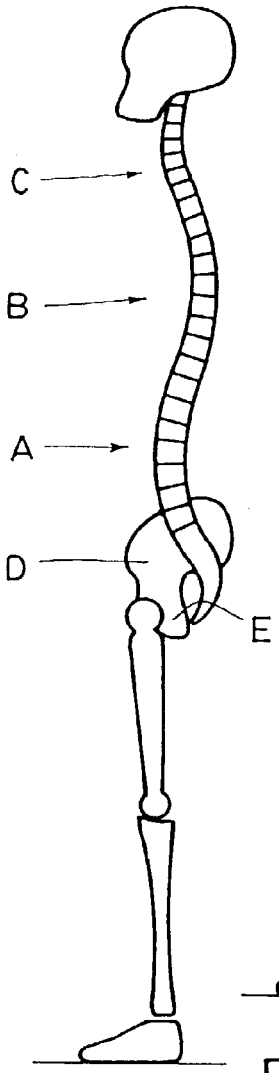

FIG. 1 shows the balanced or neutral posture of the human skeleton when standing erect. When the body stays in such a posture, the force of gravity tends to flex the joints and cause the members to sag under the weight of the body. This is avoided with the contraction of the extensors of the lower members that act in opposition to the action of gravity, thereby maintaining the erect standing posture. This muscular contraction required for this purpose is carried out by means of a reflex mechanism and does not require any attention or conscious effort.

The reflex mechanisms that regulate the posture are extraordinarily plastic, in such a way that any active or passive changes in the body posture cause correlative changes in the muscular contraction scheme, resulting in postures or attitudes appropriate to the new orientation of the body which, if held for long periods of time, cause fatigue, pains and permanent malformations, just as happens in the forced postures in certain jobs, vitiated postures in the sitting posture due the person or the design of the seat, etc.

The following postures of the spine, i.e. lumbar lordosis A (bulged to the front), dorsal kyphosis B (bulged to the back) and cervical lordosis C and, in the pelvis D, the ischiatic tuberosity E, may be identified in this figure.

Figure 2:
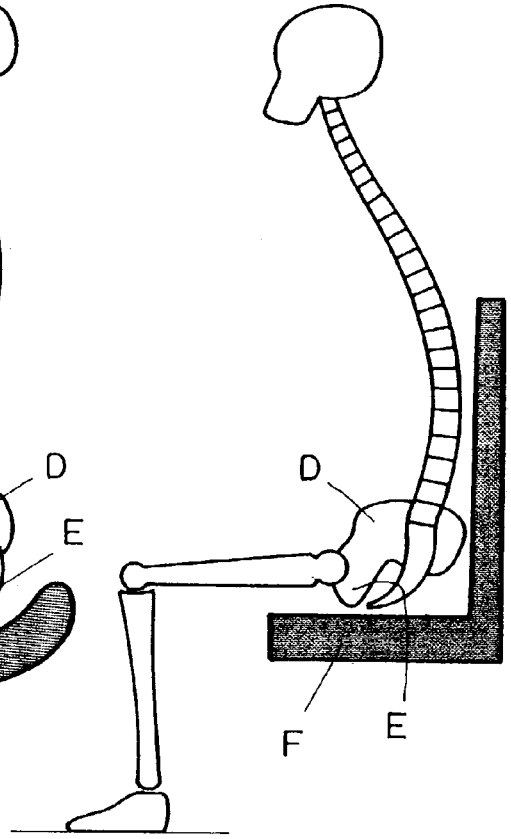

FIG. 2 shows the traditional sitting posture on a conventional seat F, in which the trunk is shown at 90° relative to the femurs and the spine has lost the physiological curves A, B and C, shown in FIG. 1, due to the backward rotation of the pelvis D.

This leads to fatigue of the extensors and deformation of the intervertebral discs and the vertebrae themselves.

Figure 3:
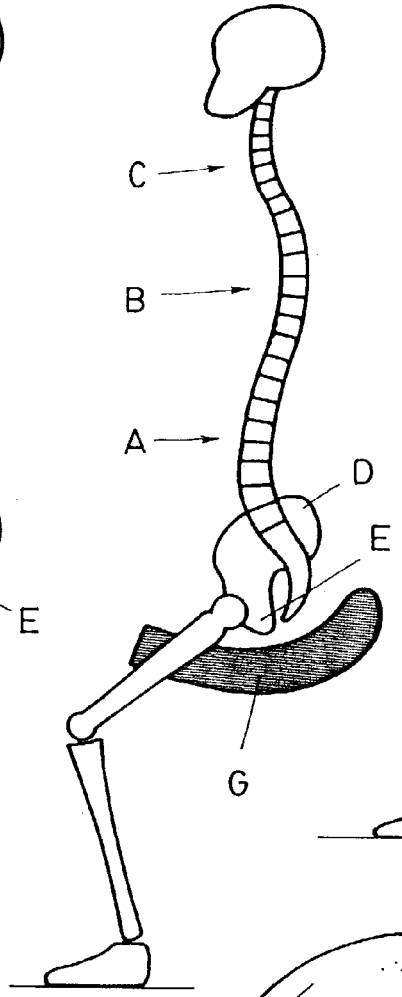

FIG. 3 shows the sitting posture astride a seat body G, where it is to be seen that the spine correctly maintains the physiological curves A, B and C, at the same time as the pelvis D, in relation to the spine, stays in the erect body posture, like in the standing posture of FIG. 1, since the pelvis D does not rotate backwardly as in the sitting posture of FIG. 2.

The invention has for object a seat that, as has already been mentioned above, is of the high stool type. It coincides with these in that it consists of an individual seat and in that it is taller than a normal chair, but it differs therefrom in that the user's thighs in the sitting posture are not horizontal, in that the user is sitting astride the seat and in that, in the sitting posture, the user's thighs form an angle of about 135° with the user's trunk, with the user's feet resting on the floor or on a footrest.

Figure 4:
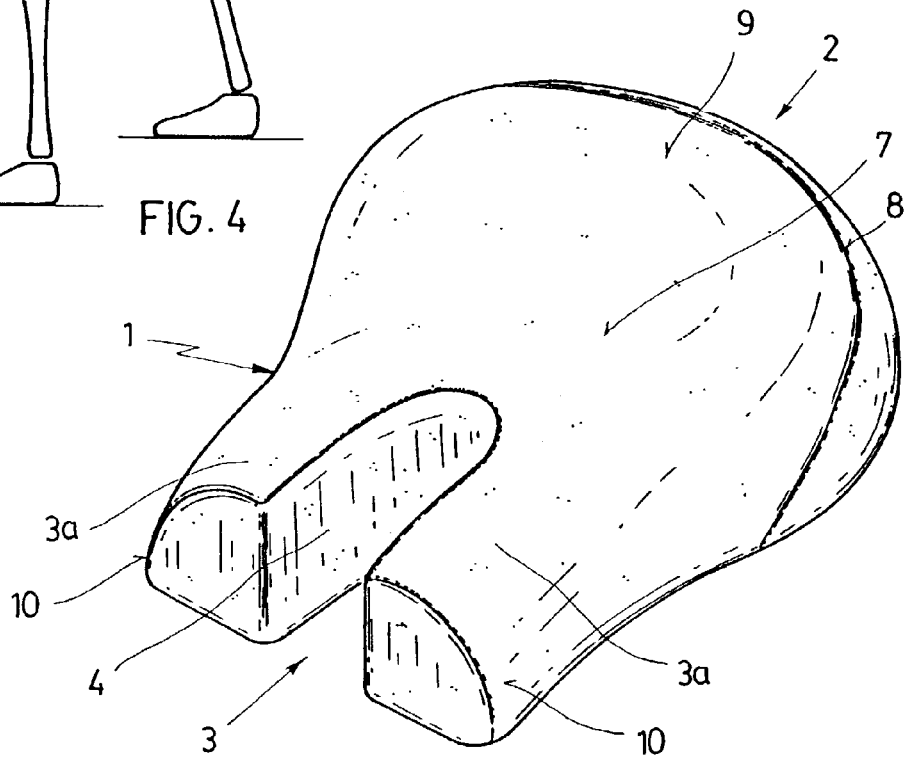
FIG. 4 is a perspective view of a preferred embodiment of a seat body of the piece of furniture of the invention.

In a seat according to the invention, as may be seen in FIG. 4, the seat as such is constituted by a seat body 1 that at the upper end thereof, on the surface of use, is differentiated into in a rear seat portion 2 for the user's buttocks and a higher front portion 3 which, inserted between the user's thighs, allows the user to sit astride it, said front portion 3 being differentiated, lengthwise down the centre, into two parallel portions 3*a* that, being mirror images, are spaced apart to define therebetween an open space 4 located in correspondence with the user's genital area and allowing the latter to be accommodated.

The distance in height between the seat body 1 and the floor or a footrest is such that, when the user is sitting astride said thick seat body 1 with the user's feet being supported, the user's thighs define an angle of approximately 135° with the vertical trunk.

Figure 6:
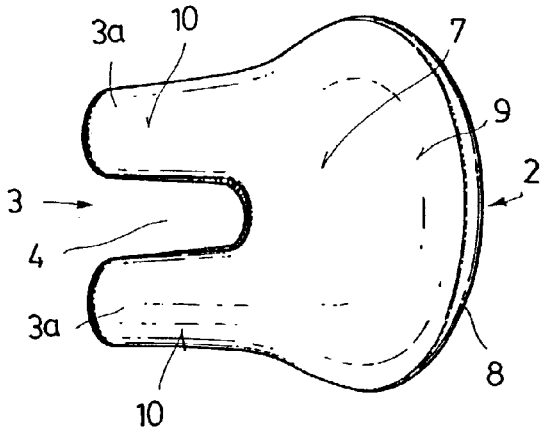
FIG. 6 is a plan view from above of the seat body of FIG. 4.

The open space 4, formed between the two portions 3*a* constitutes a wide deep gap across the entire thickness of the seat body 1, either over a part of the length thereof, as is shown in FIGS. 4 and 6, or over the entire length thereof, not shown.

Figure 7:
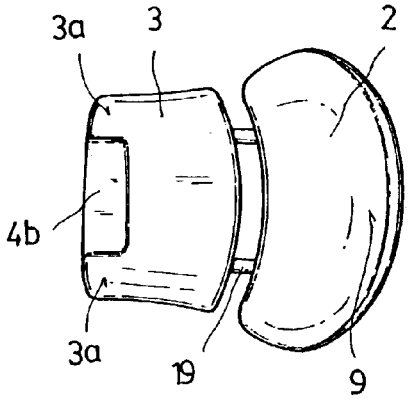
FIG. 7 is a plan view from above of an embodiment of the seat body, in which this is adjustable in the front-to-back direction.
Figure 8:
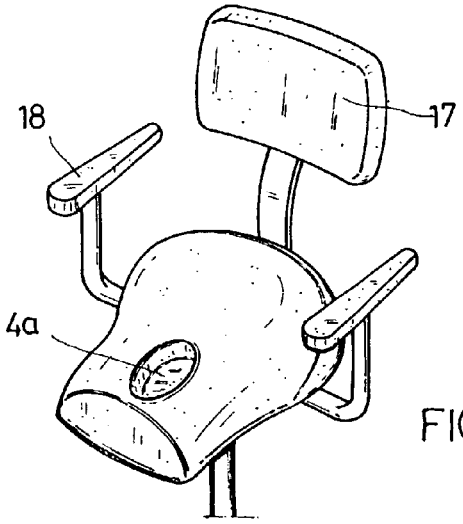
FIG. 8 is a perspective view of the seat body of FIGS. 4, 5 and 6 wherein respective backrest and armrest arrangements have been incorporated.

In other embodiments of the open space 4, it can consist of a pronounced recess 4*a*, as may be seen in FIG. 8, or of a transverse step 4*b* or front notch, as shown in FIG. 7.

In a preferred embodiment of the invention, the seat body 1 has the form of FIG. 4, which, substantially, comprises a compound plan, as may be appreciated in FIG. 6, essentially constituted by the association of a semi-ellipse and an isosceles trapezoid of curvilinear sides, the longer parallel side of which is coincident with the major axis of the semi-ellipse.

Figure 5:
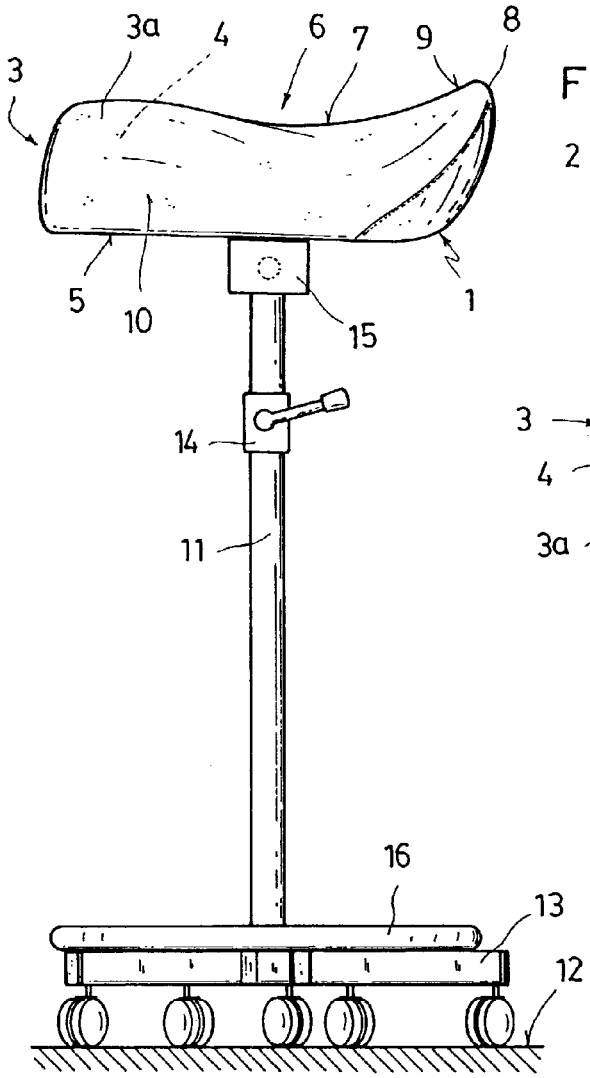
FIG. 5 is a side elevation view of the seat body of FIG. 4, installed on a conventional support structure.

In accordance with the foregoing embodiment, the materialization of the seat body 1 consists, as shown in FIGS. 4, 5 and 6, of it having a flat lower surface 5 and a bulged upper surface 6 of varying curvature that defines the surfaces of each of the rear 2 and front 3 portions that are continuous and extend from one to the other without a break, with the rear portion 2 forming a gently concave surface 7 that, transversely arcuate, tends to rise in the centre at the curvilinear free edge 8 thereof to form a rear retaining region 9 for the user's body, at the same time as, in opposition to said region, it continues, in warped form, in the front portion 3 that is formed by the two coplanar, mutually parallel rectilinear stretches 3*a* of greater height, the side surface 10 of which is transversely curved and downwardly directed towards the outside, which, being mirror images, configure therebetween a separation space in the form of a gap 4.

The seat body 1, as shown in FIG. 5, is installed on a support structure 11 standing on the floor 12, by means of a rolling foot 13 or other structure, which is provided with means 14 for regulating the height thereof, with spring means 15 for front-to-back rocking and with a footrest 16, for cases in which the user should not or cannot rest the user's feet directly on the floor.

The seat body 1 can be supplemented, as shown in FIG. 8, with an adjustable backrest 17 and armrests 18.

On the other hand, it has been foreseen, as may be seen in FIG. 7, that the front 3 and rear 2 portions of the seat body 1, constitute independent members which may be associated with one another by guide means 19 and positional adjustment means, not shown, to move them closer together or space them apart in the front-to-back direction. Similarly, according to a not shown embodiment, the seat body 1 could be divided in two side members with positional adjustment.

In the material embodiment of the seat body 1, any conventional seat construction means and any materials (plastics, wood, metal, leather, etc.) can be used.

With the foregoing disclosure, it will be seen that with the alternative proposal to the traditional sitting posture, the seat of the invention is able to maintain the physiological curves of the back, even in a leaning-forward posture, combining the following advantages:

a) The saddle design which allows an angle between the trunk and the lower extremities of approximately 135°, a posture in which the pelvis does not tilt backwards.
b) The separation of the legs that stabilizes the coxofemoral joint, increases the stability since a support triangle is formed between the seat body and the feet, creates a gripping effect on the seat body propitiated by the extension of the adductors and rotates the pelvis forwardly under the action of the psoas iliac muscles (Linden, Paul. "Compute in comfort." Prentice Hall 1995).

c) The front-to-back concavity with a peak in correspondence with the area of the ischiatic tuberosity of the pelvis, which is the one of maximum support, constitutes a fact that facilitates both the spontaneous location on the seat body and the resistance to front-to-back sliding on the surface thereof.

d) One of the most remarkable advantages in the seat body of the invention is the elimination of the genital compression by the accommodation space (gap, recess or step) provided in the seat body in the corresponding region. This allows the user both to pass extended periods of time in the neutral posture and to lean forward, without causing in either situation the compression that is as annoying as harmful. Indeed, apart from the pain that can be caused by a saddle not having the above-mentioned accommodation space as a result of chronic compression of the testicles, and accentuation thereof when leaning forward, the excess of local heat can cause a faulty production of sperm that leads to sterility (Harrison, Thorn, Adams, Braunwald, Isselbacher, Petersdorf. 1979. "Medicina Interna." La Prensa Médica Mexicana. Mexico D.F.).

In this way, the gap, recess or step of the seat body, constitutes a substantial improvement with regard to comfort and non-interference in the gonadal function, something not to be ignored when the significant reduction in male fertility in recent times is considered.

The invention claimed is:

1. A seat, characterized in that the seat is situated at a height as to allow the user to rest the user's feet on the floor or on a footrest and is constituted by a body that at the upper end thereof, on the surface of use, is differentiated into a rear seat portion for the user's buttocks, a lower middle portion and a front portion higher than the middle portion which, when inserted between the user's thighs, allows the user to sit astride it and the user's thighs to lean on it, said higher front portion being differentiated, lengthwise down the center, into two parallel portions that, being mirror images, are spaced apart to define therebetween a frontal open space which constitutes a deep notch that extends across the full thickness of said seat body and is located in correspondence with the user's genital area, allowing the user's genitals to be accommodated in said notch; said front portion having a width which is adapted to force a separation of the users legs and induce the extension of the user's adductors to create a gripping effect on the seat body, the seat body further having a generally horizontal flat lower surface and a bulged upper surface of varying curvature that defines the surfaces of each of the front and rear portions which are continuous and extend from one to the other without a break, the rear portion forming a gently concave surface that, transversely arcuate, tends to rise in the center at the curvilinear free edge thereof to form an rear retaining region of the user's body, at the same time as, in opposition to said region, it continues, in warped form, in the front portion which is formed by two coplanar, parallel rectilinear stretches of greater height, the side surface of which is convexly curved and sloping downwardly towards the outside, which stretches, being mirror images, configure therebetween a separation space across the thickness of the thick seat body.

2. The seat according to claim 1, characterized in that the seat body is of compound plan, wherein said notch is of a semi-elliptical shape, said rear seat has a bulbous curved shape and said two parallel portions have a semi-oval shape.

3. The seat according to claim 1, characterized in that the seat body is installed on a support structure standing on the floor or the like that is of adjustable height to adjust it so that the user, supporting the user's feet on the floor or on a footrest, maintains the user's thighs at an angle of about 135° with the user's trunk.

4. The seat according to claim 3, characterized in that the seat body is attached to the support structure in such a way as to allow it to rock backwards and forwards.

5. The seat according to claim 1, wherein the deep notch has a width adapted to fully accommodate male genitals.

6. The seat according to claim 1, wherein the body comprises, in plan view, a compound profile including generally trapezoidal front and middle portions, and a semi-elliptic rear portion.

* * * * *